US005592957A

United States Patent [19]

Gazerro et al.

[11] Patent Number: 5,592,957

[45] Date of Patent: Jan. 14, 1997

[54] HAIRPIECE WITH DETACHABLE PORTIONS HAVING CONTINUOUS FASTENING SEGMENTS

[76] Inventors: Carmine M. Gazerro, 9343 Sunpoint Dr.,; Richard Indiveri, 9748 El Clair Ranch Rd., both of Boynton Beach, Fla. 33437

[21] Appl. No.: 520,137

[22] Filed: Aug. 28, 1995

[51] Int. Cl.[6] ..... A41G 3/00; A41G 5/00

[52] U.S. Cl. ..... 132/53; 132/56; 132/54; 132/201

[58] Field of Search ..... 132/53, 56, 54, 132/201

[56] References Cited

U.S. PATENT DOCUMENTS

| | | | |
|---|---|---|---|
| 3,046,999 | 7/1962 | Lint | 132/54 |
| 3,295,536 | 1/1967 | Shaw et al. | 132/53 |
| 3,385,305 | 5/1968 | Buzzelli | 132/53 |
| 3,433,234 | 3/1969 | Klugmann | 132/53 |
| 3,458,943 | 8/1969 | Trowbridge | 132/53 |
| 3,495,603 | 2/1970 | Young, Jr. | 132/53 |
| 3,659,622 | 5/1972 | Meerson | 132/53 |
| 3,809,100 | 5/1974 | Megna | 132/53 |
| 3,910,292 | 10/1975 | Izzo | 132/53 |
| 4,492,242 | 1/1985 | Dalton | 132/53 |
| 4,658,841 | 4/1987 | Won | 132/53 |
| 4,825,886 | 5/1989 | Allen | 132/53 |
| 5,005,594 | 4/1991 | Dunagan | 132/53 |
| 5,117,846 | 6/1992 | Finamore et al. | 132/53 |

FOREIGN PATENT DOCUMENTS 342365 9/1904 France .

*Primary Examiner*—Gene Mancene
*Assistant Examiner*—Philogene Pedro
*Attorney, Agent, or Firm*—John R. Flanagan

[57] ABSTRACT

A hairpiece includes a rear base portion and a front base portion for attaching multiple strands of hair thereto and separate complementary fastening segments for detachably connecting the front base portion to the rear base portion. The rear base portion has a pair of opposite sides and a front end extending therebetween. The front base portion has a pair of opposite sides and a rear end extending therebetween and coextensive with the front end of the rear base portion. The complementary fastening segments are connecting bands respectively attached to the rear end of the front base portion and the front end of the rear base portion. The connecting bands have fastening elements thereon attachable to and detachable from one another to connect the front base portion to the rear base portion for use on the wearer's head and to disconnect and remove the front base portion from the rear base portion without the necessity for removal of the rear base portion from the wearer's head. The connecting bands extend continuously between the opposite sides of the front and rear base portions so that the wearer does not have to achieve precise alignment and registry of the front base portion with the rear base portion in order to connect the front base portion with the rear base portion.

18 Claims, 2 Drawing Sheets

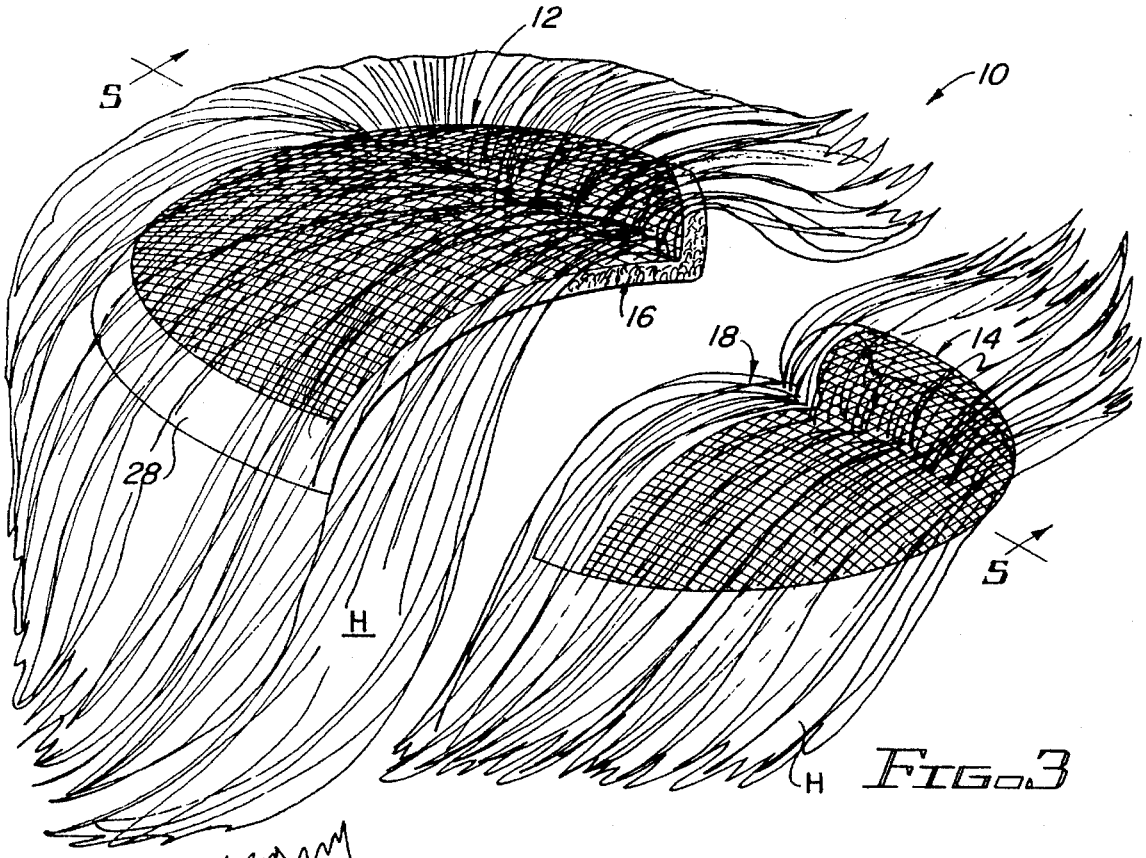
FIG. 3
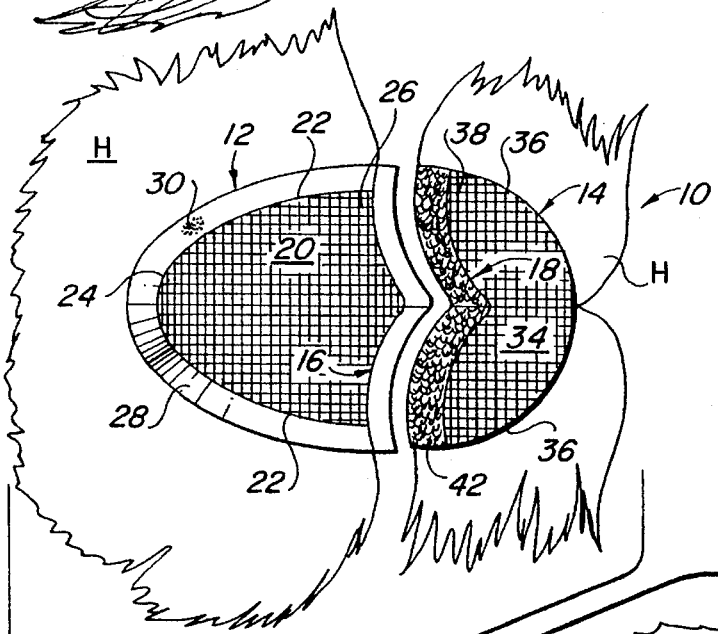
FIG. 4
FIG. 5
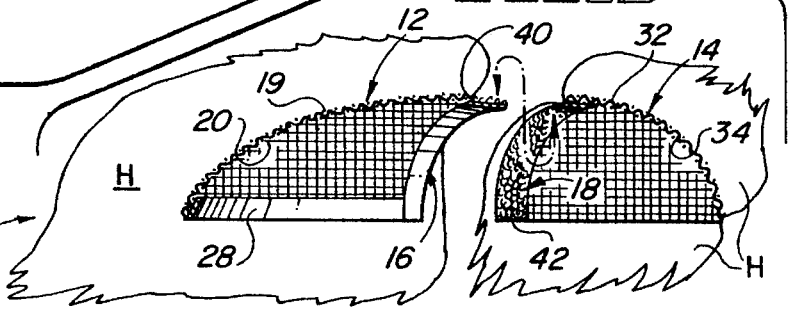

HAIRPIECE WITH DETACHABLE PORTIONS HAVING CONTINUOUS FASTENING SEGMENTS

BACKGROUND OF THE INVENTION

1. Field of the Invention

The present invention generally relates to hairpiece products and, more particularly, is concerned with a hairpiece with detachable portions having continuous fastening segments.

2. Description of the Prior Art

Hair replacement products, commonly known as hairpieces, have been used for many years by many people who have experienced bald spots and other forms of hair loss on their head. Full hairpieces such as wigs and partial hairpieces such as toupees have been among the most common forms of these hair products for some time. These hairpieces have been developed in a variety of shapes and sizes to deal with a variety of hair loss problems.

Representative examples of hair replacement devices are disclosed in U.S. Pat. No. 3,433,234 to Klugmann, U.S. Pat. No. 3,458,943 to Trowbridge, U.S. Pat. No. 3,495,603 to Young, Jr., U.S. Pat. No. 3,659,622 to Meerson, U.S. Pat. No. 3,809,100 to Megna, U.S. Pat. No. 4,658,841 to Won and French Pat. No. 342,365 to Gaillard. The Young, Jr., Won and Gaillard patents particularly provide devices having detachable and interchangeable hairpiece portions with a common element being multiple discrete connections generally in the form of snap or strip fastening elements which appear to require precise registry of the fastening parts for a proper fit. A problem exists, however, with these devices in that such means which require a precise registry of fastening parts for reconnection of a hairpiece portion can be cumbersome and tedious to the wearer.

Consequently, a need remains for a hair replacement device which overcomes the aforementioned problem in the prior art without introducing any new problems in their place.

SUMMARY OF THE INVENTION

The present invention provides a hairpiece with a detachable portions having continuous fastening segments designed to satisfy the aforementioned need. The continuous fastening segments permit detachably connecting a front base portion to a rear base portion of the hairpiece to thereby facilitate removal, cleaning, repair and/or replacement of the front base portion without the necessity for removal of the rear base portion from a wearer's head. Their continuous fastening property makes the fastening segments less tedious to use and does not require the level of precision to reattach the front base portion to the rear base portion as do the multiple discrete connections of the prior art.

Accordingly, the present invention is directed to a hairpiece with detachable portions having continuous fastening segments. The hairpiece comprises: (a) a rear base portion for connecting multiple strands of hair thereto, the rear base portion having a top surface for the multiple strands of hair to extend thereover, a pair of opposite sides, and a front end extending between the opposite sides; (b) a front base portion for connecting multiple strands of hair thereto, the front base portion having a top surface for the multiple strands of hair to extend thereover, a pair of opposite sides, and a rear end extending between the opposite sides and coextensive with the front end of the rear base portion; and (c) means for releasably connecting the rear end of the front base portion to the front end of the rear base portion continuously between the pairs of opposite sides of the front and rear base portions so as to relieve the wearer of the necessity to achieve precise alignment and registry of the front base portion with the rear base portion in order to connect the front base portion with the rear base portion.

The rear base portion also has a bottom surface for applying to a top rear region of a wearer's head and a rear end spaced opposite the rear end and extending between the opposite sides. The front base portion also has a bottom surface for applying to a top front region of the wearer's head. The hairpiece further comprises means for attaching the bottom surface of the rear base portion to the wearer's head.

More particularly, the connecting means is a pair of releasable complementary fastening segments in the form of front and rear connecting bands which are attachable to and detachable from one another to connect the front base portion to the rear base portion for use on the wearer's head and to disconnect and remove the front base portion from the rear base portion. Each of the connecting bands is made substantially of an inelastic material and has a pair of opposite surfaces. Preferably, the rear connecting band is attached along and extends forwardly of the front end of the rear base portion, while the front connecting band is attached along and underlies the bottom surface at the rear end of the front base portion. The connecting bands are attachable to and detachable from one another along respective facing surfaces thereof to connect the front base portion to the rear base portion for use on the wearer's head and to disconnect and remove the front base portion from the rear base portion so as to clean, repair or replace the front base portion.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 3 is a top perspective view of another hairpiece of the present invention showing rear and front base portions detached from one another and continuous fastening segments having substantially V-shaped configurations.

FIG. 4 is a bottom plan view of the hairpiece of FIG. 3 shown on a reduced scale.

FIG. 5 is a longitudinal sectional view of the hairpiece taken along line 5—5 of FIG. 3 shown on a reduced scale.

DETAILED DESCRIPTION OF THE INVENTION

Figure 1:
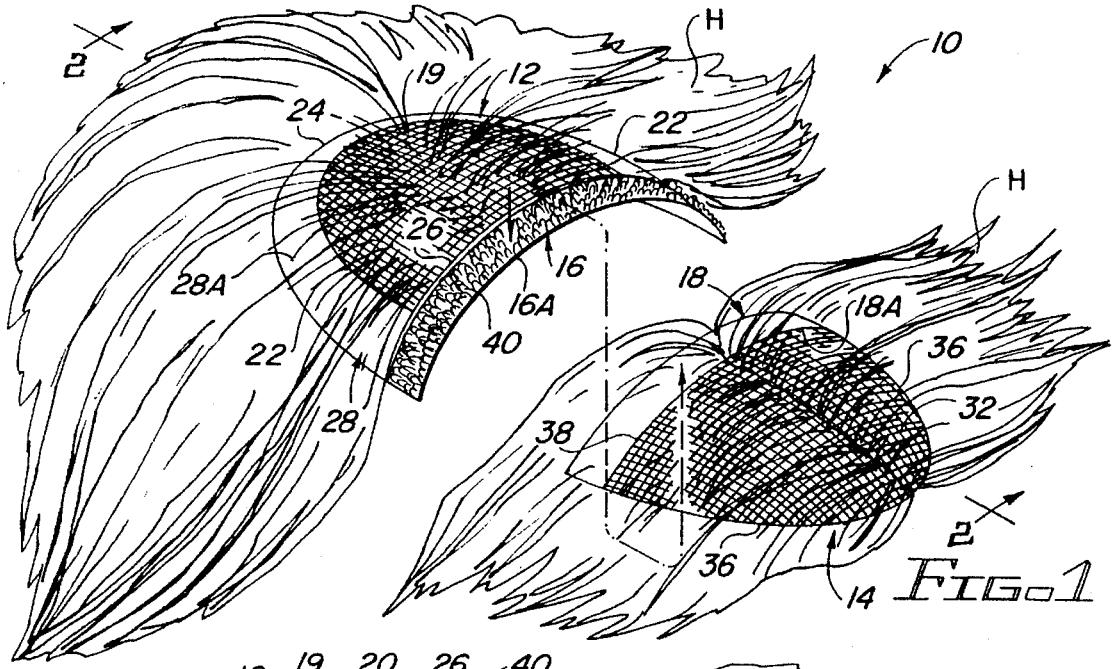
FIG. 1 is a top perspective view of the hairpiece of the present invention showing rear and front base portions detached from one another and continuous fastening segments having substantially straight configurations.
Figure 2:
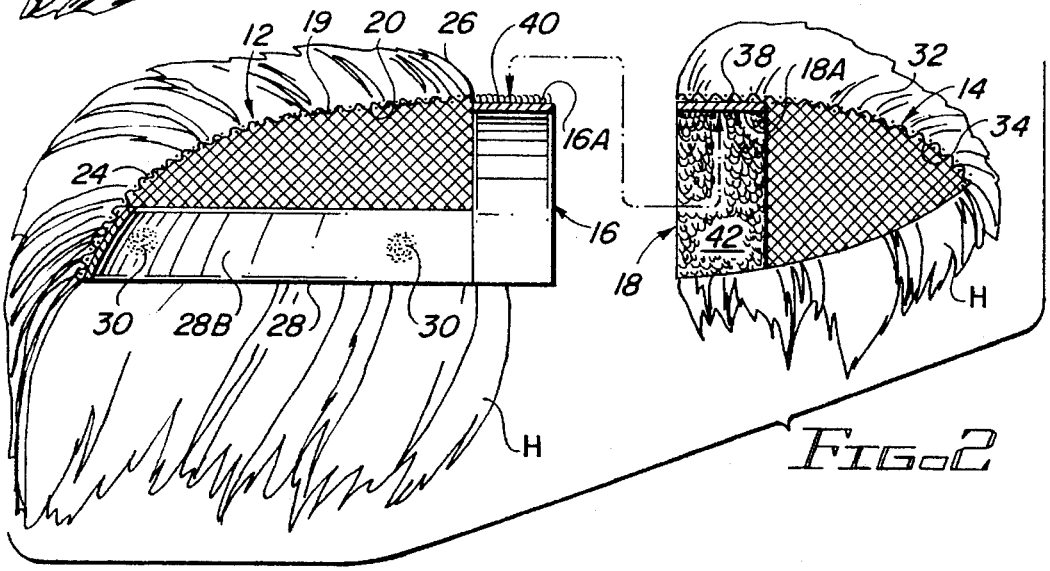
FIG. 2 is a longitudinal sectional view of the hairpiece taken along line 2—2 of FIG. 1.

Referring to the drawings, and particularly to FIGS. 1 and 2, there is illustrated a hairpiece, generally designated 10, of the present invention. The hairpiece 10 particularly has detachable portions fastened together by continuous means which makes the hairpiece less tedious to take care of and does not require the level of precision to realign and reattach the detachable portions as do discrete connections found in the prior art.

Basically, the hairpiece 10 includes an outer rear base portion 12 and a front base portion 14 for attaching respective groups of multiple strands of hair H thereto. The hairpiece 10 also includes separate releasable complementary front and rear fastening segments 16, 18 for detachably connecting the front base portion 14 to the rear base portion to facilitate removal, cleaning, repair and/or replacement of the front base portion 14 without the necessity for removal of the rear base portion 12 from the wearer's head.

The outer rear base portion 12 of the hairpiece 10 has a top surface 19 for the multiple strands of hair H to extend thereover and a bottom surface 20 for applying to a top rear region of a wearer's head (not shown). The rear base portion 12 also has a pair of opposite sides 22, a rear end 24 extending between the opposite sides 22, and a front end 26 spaced forwardly from the rear end 24 and extending between the opposite sides 22. As seen in FIG. 1, the opposite sides 22 converge rearwardly toward one another and merge with the rear end 24. The hairpiece 10 also includes means 28 disposed between the outer rear base portion 12 and the wearer's head for attaching the bottom surface 20 to the wearer's head. The attaching means 28 is particularly a U-shaped band 28 made substantially of an inelastic material and has a pair of opposite upper and lower surfaces 28A, 28B. The band 28 at its upper surface 28A is attached to the rear end 24 and opposite sides 22 of the bottom surface 20 of the rear base portion 12. The lower surface 28B of the band 28 has an adhesive substance 30 thereon for attachment to the top rear region of the wearer's head.

The front base portion 14 of the hairpiece 10 has a top surface 32 for the multiple strands of hair H to extend thereover and a bottom surface 34 for applying to a top front region of the wearer's head. The front base portion 14 also has a pair of opposite sides 36, and a rear end 38 extending between the opposite sides 36 and coextensive with the front end 26 of the rear base portion 12.

The releasable complementary front and rear fastening segments 16, 18 of the hairpiece 10 are attached respectively to the front end 26 of the rear base portion 12 and the rear end 24 of the front base portions 14. The complementary front and rear fastening segments 16, 18 are attachable to and detachable from one another to connect the front base portion 14 to the rear base portion 12 applied on the wearer's head and to disconnect and remove the front base portion 14 from the rear base portion 12. Also, the complementary front and rear fastening segments 16, 18 extend continuously between the pairs of opposite sides 22, 36 of the rear and front base portions 12, 14 so as to relieve the wearer of the necessity to achieve precise alignment and registry of the front base portion 14 with the rear base portion 12 in order to connect the front base portion 14 with the rear base portion 12.

More particularly, the releasable complementary front and rear fastening segments 16, 18 respectively take the form of front and rear connecting bands 16, 18. The rear connecting band 18is attached by any suitable means along and substantially extends forwardly of the front end 26 of the rear base portion 12. The front connecting band 16 is attached by any suitable means along and substantially underlies the bottom surface 34 of the front base portion 14 at the rear end 24 of the front base portion 14. Further, the front and rear connecting bands 16, 18 have fastening means 40, 42 on the facing surfaces 16A, 18A thereof so as to make the front and rear connecting bands 16, 18 attachable to and detachable from one another along the respective facing surfaces 16A, 18A to releasable connect the front base portion 14 to the rear base portion 12.

Also, each of the front and rear connecting bands 16, 18 is made substantially of a suitable inelastic material and extend continuously between the respective pairs of opposite sides 22, 36 of the rear and front base portions 12, 14. The bands 16, 18 have either a substantially straight configuration, as shown in FIGS. 1 and 2, or a substantially V-shaped configuration, as shown in FIGS. 3 to 5. The facing surfaces 16A, 18A of the bands 16, 18 are overlapped with one another such that the fastening means 40, 42 thereon which extends between the opposite ends of the bands 16, 18 releasably fasten the bands to one another along the facing surfaces. The fastening means 40, 42 can take several suitable forms, such as a suitable releasable adhesive substance or complementary opposite hook and loop fastening elements. Also, each of the bands 16, 18 has a length substantially greater than the width thereof.

Finally, the rear base portion 12 preferably has a surface area larger than that of the front base portion 14 and larger than that of the U-shaped band 28 and the rear connecting band 18 combined. However, the rear base portion 12 may also have a surface area substantially equal to or smaller than that of the front base portion 14. The rear and front base portions 12, 14 preferably are fabricated from perforated materials or nettings conventional per se in the art for attachment thereto of the multiple strands of hair H. Furthermore, the rear base portion 12 is preferably attached to the wearer's head by the adhesive substance 30 which has relatively stronger bonding properties than that of the adhesive substance used for releasably fastening the front and rear connecting bands 16, 18 together. The adhesive substance 30 is meant to last for a period of attachment longer than that of the adhesive substance of the bands 16, 18 which are considered one form of the releasable fastening elements of the present invention.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A hairpiece, comprising:

(a) an outer rear base portion for connecting multiple strands of hair thereto, said outer rear base portion having a top surface for the multiple strands of hair to extend thereover and a bottom surface for applying to a top rear region of a wearer's head, said outer rear base portion also having a rear end, a pair of opposite sides converging rearwardly toward one another and merging with said rear end, and a front end spaced forwardly of said rear end and extending between said opposite sides;

(b) an inner U-shaped band disposed between said outer rear base portion and the wearer's head and having opposite upper and lower surfaces, said inner U-shaped band being fixedly attached at said upper surface thereof to said bottom surface of said rear base portion along said rear end and said opposite sides thereof;

(c) an adhesive substance applied on said lower surface of said inner U-shaped band for releasably attaching said band to the wearer's head;

(d) a front base portion for connecting multiple strands of hair thereto, said front base portion having a top surface for the multiple strands of hair to extend thereover, a pair of opposite sides, and a rear end extending therebetween and coextensive with said front end of said rear base portion; and (e) means for releasably connecting said rear end of said front base portion to said front end of said rear base portion continuously between said pairs of opposite sides of said front and rear base portions with one of said rear end of said front base portion and said front end of said rear base portion overlapping the other thereof so as to relieve a wearer of the necessity to achieve precise alignment and registry of said front base portion with said rear base portion in order to connect said front base portion with said rear base portion.

2. The hairpiece of claim 1 wherein said releasable connecting means is a pair of complementary fastening segments attached respectively to said front end of said rear base portion and said rear end of said front base portions, said complementary fastening segments being attachable to and detachable from one another to connect said front base portion to said rear base portion on the wearer's head and to disconnect and remove said front base portion from said rear base portion.

3. The hairpiece of claim 2 wherein said complementary fastening segments are respective front and rear connecting bands, said rear connecting band being attached along and extending forwardly of said front end of said rear base portion, said front connecting band being attached along and underlying a bottom surface of said front base portion at said rear end thereof the front base portion.

4. The hairpiece of claim 3 wherein said front and rear connecting bands have fastening material on facing surfaces thereof so as to make said front and rear connecting bands attachable to and detachable from one another along said respective facing surfaces thereof to connect said front base portion to said rear base portion.

5. The hairpiece of claim 1 wherein said connecting means is a pair of complementary releasable connecting bands attached to said front end of said rear base portion and to said rear end of said front base portion, said connecting bands having fastening means thereon being attachable to and detachable from one another to connect said front base portion to said rear base portion for use on the wearer's head and to disconnect and remove said front base portion from said rear base portion so as to permit cleaning, repair or replacement of said front base portion.

6. The hairpiece of claim 5 wherein said connecting bands extend continuously across said front end of said rear base portion and across said rear end of said front base portion between said respective pairs of opposite sides thereof.

7. The hairpiece of claim 5 wherein each of said connecting bands is made substantially of an inelastic material.

8. The hairpiece of claim 5 wherein each of said connecting bands has a substantially straight configuration.

9. The hairpiece of claim 5 wherein each of said connecting bands has a substantially V-shaped configuration.

10. The hairpiece of claim 5 wherein said fastening means on each of said connecting bands is made substantially of an adhesive substance.

11. The hairpiece of claim 5 wherein said fastening means on said connecting bands are hook and loop fastening elements.

12. A hair replacement device, comprising:

(a) an outer rear base portion for connecting multiple strands of hair thereto, said outer rear base portion having a top surface for the multiple strands of hair to extend thereover and a bottom surface for applying to a top rear region of a wearer's head, said outer rear base portion also having a rear end, a pair of opposite sides converging rearwardly toward one another and merging with said rear end which extends between said opposite sides, and a front end spaced forwardly of said rear end and extending between said opposite sides;

(b) an inner U-shaped band disposed between said outer rear base portion and the wearer's head and having opposite upper and lower surfaces, said inner U-shaped band being fixedly attached at said upper surface thereof to said bottom surface of said rear base portion-along said rear end and said opposite sides of said rear base portion for attaching said rear base portion to the wearer's head;

(c) an adhesive substance applied on said lower surface of said inner U-shaped band for releasably attaching said band to the wearer's head;

(d) a front base portion for connecting multiple strands of hair thereto, said front base portion having a top surface for the multiple strands of hair to extend thereover, a bottom surface for applying to a top front region of the wearer's head, a pair of opposite sides, and a rear end extending between said opposite sides and coextensive with said front end of said rear base portion; and (e) a pair of complementary releasable connecting bands attached to said front end of said rear base portion and to said rear end of said front base portion for overlapping one another to position said connecting bands for connecting with one another, said connecting bands having fastening means thereon such that said connecting bands upon being overlapped with one another are attachable to and detachable from one another to connect said front base portion to said rear base portion and to disconnect and remove said front base portion from said rear base portion, said fastening means extending continuously between said respective pairs of opposite sides of said rear base portion and said front base portion to relieve the wearer of the necessity to achieve precise alignment and registry of said rear base portion and said front base portion in order to connect said front base portion with said rear base portion.

13. The hairpiece of claim 12 wherein said connecting bands extend continuously across said front end of said rear base portion and across said rear end of said front base portion between said respective pairs of opposite sides thereof.

14. The hairpiece of claim 12 wherein each of said connecting bands is made substantially of an inelastic material.

15. The hairpiece of claim 12 wherein each of said connecting bands has a substantially straight configuration.

16. The hairpiece of claim 12 wherein each of said connecting bands has a substantially V-shaped configuration.

17. The hairpiece of claim 12 wherein said fastening means on each of said connecting bands is made substantially of an adhesive substance.

18. The hairpiece of claim 12 wherein said fastening means on said connecting bands are hook and loop fastening elements.

* * * * *